US010858752B2

(12) United States Patent
Renaud

(10) Patent No.: US 10,858,752 B2
(45) Date of Patent: Dec. 8, 2020

(54) METHOD FOR TREATING SURFACES OF GEOMETRICALLY COMPLEX PARTS, PART-CARRYING DEVICE AND TREATMENT DEVICE

(71) Applicant: Maxence Renaud, Santeny (FR)

(72) Inventor: Maxence Renaud, Santeny (FR)

( * ) Notice: Subject to any disclaimer, the term of this patent is extended or adjusted under 35 U.S.C. 154(b) by 383 days.

(21) Appl. No.: 15/736,365

(22) PCT Filed: Jun. 17, 2016

(86) PCT No.: PCT/FR2016/051481

§ 371 (c)(1),
(2) Date: Dec. 14, 2017

(87) PCT Pub. No.: WO2016/203173

PCT Pub. Date: Dec. 22, 2016

(65) Prior Publication Data

US 2018/0163320 A1 Jun. 14, 2018

(30) Foreign Application Priority Data

Jun. 17, 2015 (FR) ..... 15 55540

(51) Int. Cl.

| | |
|---|---|
| ***C25D 17/08*** | (2006.01) |
| ***C25D 11/00*** | (2006.01) |
| ***C25D 21/10*** | (2006.01) |
| ***C25D 7/06*** | (2006.01) |

(52) U.S. Cl.

CPC ..... *C25D 17/08* (2013.01); *C25D 7/06* (2013.01); *C25D 11/005* (2013.01); *C25D 21/10* (2013.01)

(58) Field of Classification Search

CPC ..... C25D 7/06; C25D 21/10; C25D 21/12

See application file for complete search history.

(56) References Cited

U.S. PATENT DOCUMENTS

| | | | |
|---|---|---|---|
| 5,360,527 | A | 11/1994 | Ribitch |
| 2005/0056542 | A1 | 3/2005 | Mitsui et al. |
| 2008/0277286 | A1 | 11/2008 | Richardson et al. |

FOREIGN PATENT DOCUMENTS

| | | | | |
|---|---|---|---|---|
| DE | 664 239 | C | 8/1938 | |
| EP | 1 455 006 | A1 | 9/2004 | |
| FR | 2 714 079 | A1 | 6/1995 | |
| FR | 2 823 769 | A1 | 10/2002 | |
| FR | 2 832 429 | A1 | 5/2003 | |
| GB | 1 428 856 | A | 3/1976 | |
| JP | 01294898 | A * | 11/1989 | ..... C25D 17/08 |

OTHER PUBLICATIONS

Machine translation of JP01-294898. (Year: 1989).*

International Search Report, dated Sep. 2, 2016, from corresponding PCT/FR2016/051481 application.

* cited by examiner

*Primary Examiner* — Brian W Cohen

(74) *Attorney, Agent, or Firm* — Nixon & Vanderhye

(57) ABSTRACT

A part-carrier for electrolytically treating geometrically complex parts includes a reinforcement vertically supporting supports that are movable in rotation and designed to carry the parts to be treated, and a control member which, when activated, pivots the movable supports in sequence to either side of a neutral initial position. Application to electroplating.

2 Claims, 12 Drawing Sheets

METHOD FOR TREATING SURFACES OF GEOMETRICALLY COMPLEX PARTS, PART-CARRYING DEVICE AND TREATMENT DEVICE

The present invention generally relates to the electrolytic or anodic oxidation surface treatment, in particular electroplating, of surfaces of geometrically complex parts made of metal or metallizable plastic material (ABS, PA, PP, ABS PC, . . . ).

Conventionally, the parts whose faces are intended to be coated by an electrolytic treatment, in particular electroplating, are arranged in an electrolysis bath contained in a treatment tank by means of a part-carrier constituting the cathode of the device. Typically, the parts are placed in the bowl in a fixed position opposite the anodes of the treatment device in such a manner that the surfaces to be treated of the parts are located as directly opposite the anodes as possible.

In operation, the lines of current in the bath conventionally going from the anodes to the cathodes reach in priority the part surfaces that are directly exposed to the anodes. This situation is acceptable for the treatment of geometrically simple parts, where the part surfaces to be treated are all sufficiently exposed to the lines of current when the part is in a fixed initial position. On the other hand, in the case of geometrically complex parts, i.e. which have, in the fixed initial position, surfaces that are totally or partially masked with respect to the anodes, the lines of current will reach only partially, or even not at all, these surfaces that are a little or not exposed to the anodes.

It results therefrom that the treatments, in particular the electroplated coatings on the surfaces, are different and non-homogeneous. In particular, the thicknesses of the coatings will be different from one surface to another of the parts and the parts won't fulfil the specifications.

The inventors have studied the impact of the lines of current on the surfaces of geometrically complex parts to be treated, as a function of the orientation of the parts with respect to the anodes of a treatment device. This study is schematically illustrated by FIGS. 1A to 1C.

In FIG. 1A, the parts 6 to be treated are in a neutral initial position with respect to the anodes 2. In this case, the impact of the lines of current 3 is admittedly of 80% on the surface A of the parts, but is only of 10%, 20% and 10%, respectively, for the surfaces B, C and D.

If a rotation of the parts 1 by 45° in the clockwise or in the anticlockwise direction is performed, as shown in FIGS. 1B and C, then the impact of the lines of current on the different surfaces is established as follows:

| Rotation by 45° in the clockwise direction | | Rotation by 45° in the anticlockwise direction | |
|---|---|---|---|
| Surface | Impact % | Surface | Impact % |
| A | 75 | A | 75 |
| B | 80 | B | 10 |
| C | 10 | C | 80 |
| D | 50 | D | 50 |

Generally, the present invention hence aims to solve the problem of uniformizing the electrolytic or anodic oxidation treatment, in particular electroplating, of the surfaces of geometrically complex parts and, more particularly, uniformizing the electroplated coatings.

The documents FR-2.832.429 and FR-2.714.079 describe part-carrier devices for the electrolytic or anodic oxidation treatment.

In these documents, the objects to be treated are arranged on horizontal rods able to rotate about their longitudinal axis. The rotation occurs once the treatment terminated, after removal of the part-carrier device from the treatment bath, and has for object to eliminate the excess of treatment bath liable to remain in the parts.

The document GB-1.428.856 describes a device in which the parts to be treated, carried by horizontal rods, are liable to freely oscillate during the treatment in order to ensure an agitation of the treatment bath.

In the field of electrolytic treatment, the following documents are also known: US2008/277286A1, US2005/056542A1, U.S. Pat. No. 5,360,527A, EP1455006A1, FR2823769A1 and DE664239C.

In order to remedy the above-mentioned drawback of the state of the art, the present invention proposes a method for electrolytic or anodic oxidation treatment, in particular electroplating, of surfaces of geometrically complex parts, ensuring an optimum access to the surfaces of the complex parts during the treatment.

More particularly, the present invention has for object such method for electrolytic or anodic oxidation treatment that ensures an optimum exposure of the surfaces of complex parts to the lines of current during the treatment and, as a result, a treatment, for example an electroplated coating, as uniform as possible, on the surfaces of the complex parts.

The invention has also for object a device for electrolytic or anodic oxidation treatment designed for the implementation of the method.

The invention has finally for object a part-carrier capable of ensuring an optimum exposure of the surfaces of complex parts to the lines of current during an electrolytic or anodic oxidation treatment, in particular electroplating.

The objects hereinabove are achieved according to the invention by a method for electrolytic or anodic oxidation treatment, in particular electroplating, which comprises the positioning in a so-called neutral initial position, by means of a removable part-carrier constituting a first electrode in a treatment bath contained in a tank including a second electrode of polarity opposite to that of the first electrode, of geometrically complex parts, characterized in that:

a) the geometrically complex parts are such that, in a neutral initial position, surfaces of these geometrically complex parts are a little or not reached by the lines of current established between the first and the second electrode during the implementation of the treatment method; and b) during the treatment of the geometrically complex parts, the parts are subjected to sequential rotations on either side of their neutral initial position by an angle liable to go up to 90°, in particular of 45°, so as to increase the exposure to the lines of current of the surfaces of the geometrically complex parts that are initially a little or not reached.

According to the invention, the angles of rotation of the complex parts are chosen as a function of the treatment and of the geometry of the parts, so as to expose optimally the surfaces initially non-exposed to the lines of current established during the treatment.

Those sequential angles of rotation are generally comprised between 5 and 90° on either side of the neutral initial position.

During a treatment, the geometrically complex parts are subjected to sequential rotations by different angles on either side of their neutral initial position and are held in each of these different positions during a treatment time sufficient to obtain a treatment as uniform as possible of the part surfaces, in particular an electroplated coating, for example by electroplating.

Of course, the method of the invention may be implemented by means of a computer program designed as a function of the geometric complexity of the parts to be treated and of the contemplated treatment.

The invention also relates to a part-carrier for the electrolytic or anodic oxidation treatment, in particular electroplating, of geometrically complex parts, comprising:

- a reinforcement made of an electrically conductive material having upper and lower horizontal sides connected to each other by vertical lateral sides;
- rotatably mobile supports designed to carry the parts to be treated;

characterized in that:

- the mobile supports are held vertically between the upper and lower sides of the reinforcement so as to be able to pivot about a vertical pivoting axis;
- the upper end of each of the mobile supports includes an element cooperating with a control member whose actuation make the mobile supports pivot sequentially, preferably by a maximum angle of 90°, and typically up to an angle of at least 45°, on either side of a neutral initial position.

The part-carriers according to the invention can also have the following characteristics, considered in isolation or according to any technically possible combination thereof:

- the upper side of the reinforcement is consisted by an electrically conductive rod allowing the vertical holding of the part-carrier device in a treatment tank and the removal thereof form the treatment tank;
- the control member is integral with the upper horizontal side of the reinforcement;
- the control member is a rack moveable linearly according to a reciprocating movement and the elements at the upper ends of the mobile supports are pinions engaging with the rack;
- the control member is designed to be removably connected to an actuator, for example an electric cylinder;
- the actuator is integral with the upper side of the reinforcement;
- the mobile supports are vertically rotatably held in the reinforcement by means of bearings.

In a preferred embodiment of the part-carrier of the invention, the parts to be treated are held back-to-back by pairs along the supports.

The invention also relates to a device for electrolytic or anodic oxidation treatment, in particular electroplating, comprising:

- at least one treatment tank having an open upper surface, adapted to contain a treatment bath and in which is vertically arranged at least one first electrode, generally an anode;
- a part-carrier as defined hereinabove constituting a second electrode, of polarity opposite to that of the first electrode, generally a cathode, which can be arranged vertically in the tank, so that parts carried by the part-carrier are in an initially neutral position opposite the first electrode, and
- at least one actuator of the control member of the part-carrier.

In an embodiment of the invention, the treatment tank comprises, inside the tank, arranged vertically, a first electrode, typically an anode, a third electrode of same polarity as that of the first electrode and spaced apart from this first electrode, the part-carrier being removably arranged between the first and the third electrode.

Preferably, the first and the third electrode are anodes and the part-carrier device constitutes a cathode.

In an embodiment of the treatment device according to the invention, the actuator of the control member is integral with the treatment tank.

The treatment device according to the invention may comprise several successive treatment tanks for the full treatment of the parts, the parts to be treated being placed successively in the different tanks for the treatment thereof by means of a single part-carrier according to the invention. In this case, it may be provided on each tank an actuator connectable to the control member of the part-carrier.

As a variant, the actuator of the control member may be integral with the part-carrier and will be transported with the part-carrier from tank to tank up to the completion of the process of treatment of the parts.

As a variant, the control member comprises a control arm connectable to an external actuator, in particular fixed on a treatment tank.

The following description in relation with the appended drawings, given by way of non-limitative examples, will allow a good understanding of what the invention is consisted in and how it may be implemented.

The following of the description refers to the appended figures, in which:

FIGS. 1A to 10 are schematic representations of the impact of the lines on the surfaces of a geometrically complex part as a function of the orientation thereof;

FIG. 2 is a perspective view of an embodiment of a part-carrier according to the invention in its neutral initial position;

FIG. 3 is a perspective view of the part-carrier of FIG. 1, after a rotation by 45° in the clockwise direction with respect to the neutral initial position;

FIG. 5 is a schematic perspective view of the part-carrier of FIG. 1 placed in a treatment tank;

FIG. 6 is a top view of the part-carrier and of the treatment tank of FIG. 5, with the parts to be treated in their neutral initial position with respect to the anodes;

FIGS. 7 and 8 are top views similar to FIG. 6, after rotation by 45° of the parts to be treated, on either side, respectively, of the neutral initial position;

FIGS. 9 to 10 are schematic top and perspective views, respectively, of an embodiment of the part-carriers and of a treatment tank according to the invention, the part-carrier being taken out of the tank.

FIGS. 2, 2A and 2B show a face and top perspective view, respectively, of an embodiment of a part-carrier 1 according to the invention.

The part-carrier 1 comprises a generally rectangular reinforcement 2, made of an electrically conductive material, including an upper side 2*a*, a lower side 2*b* and two lateral sides 2*c*.

Figure 1C:
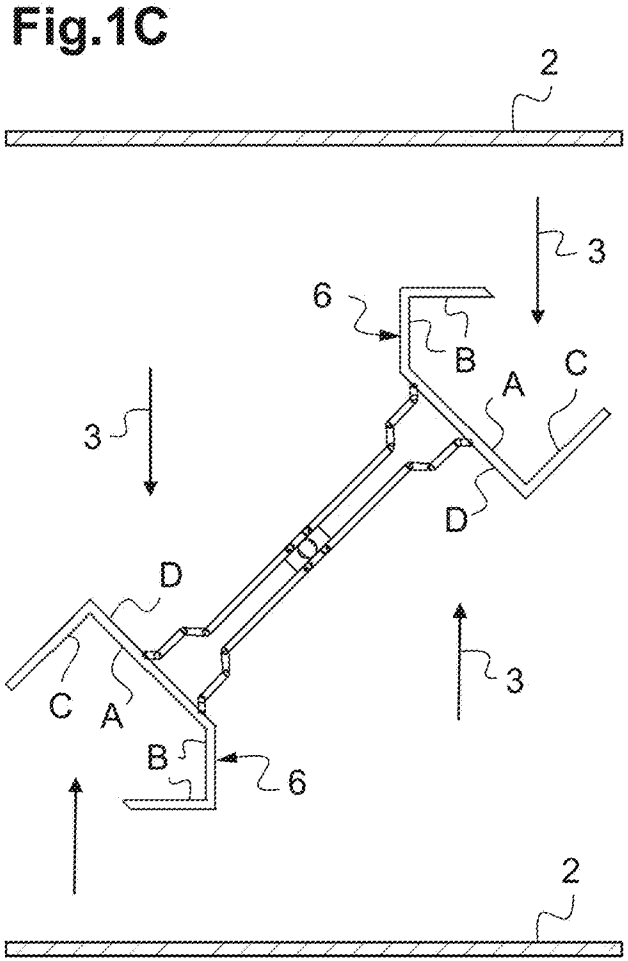
Figure 1B:
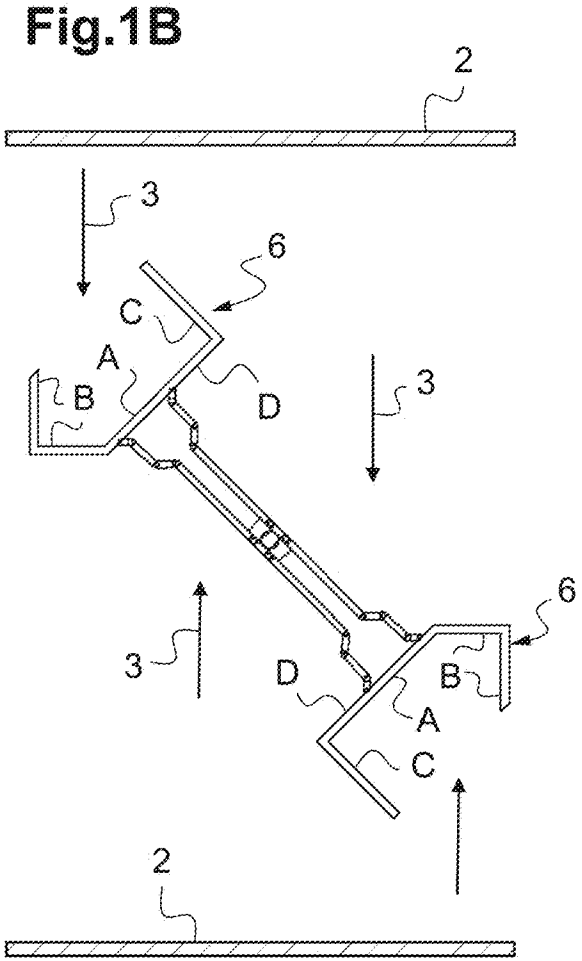
Figure 1A:
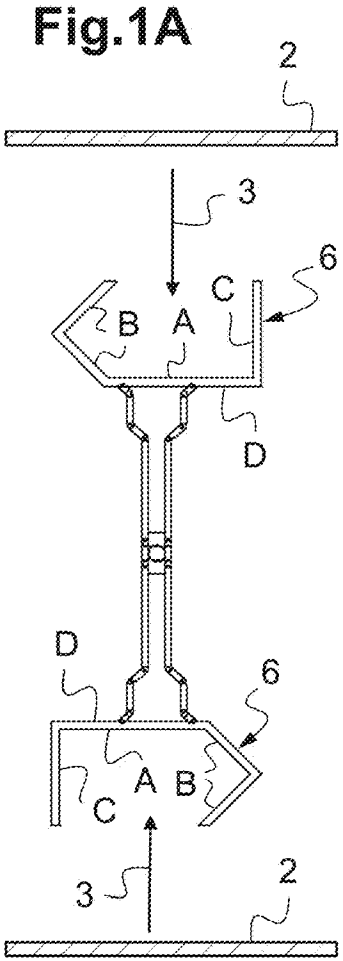
Figure 2:
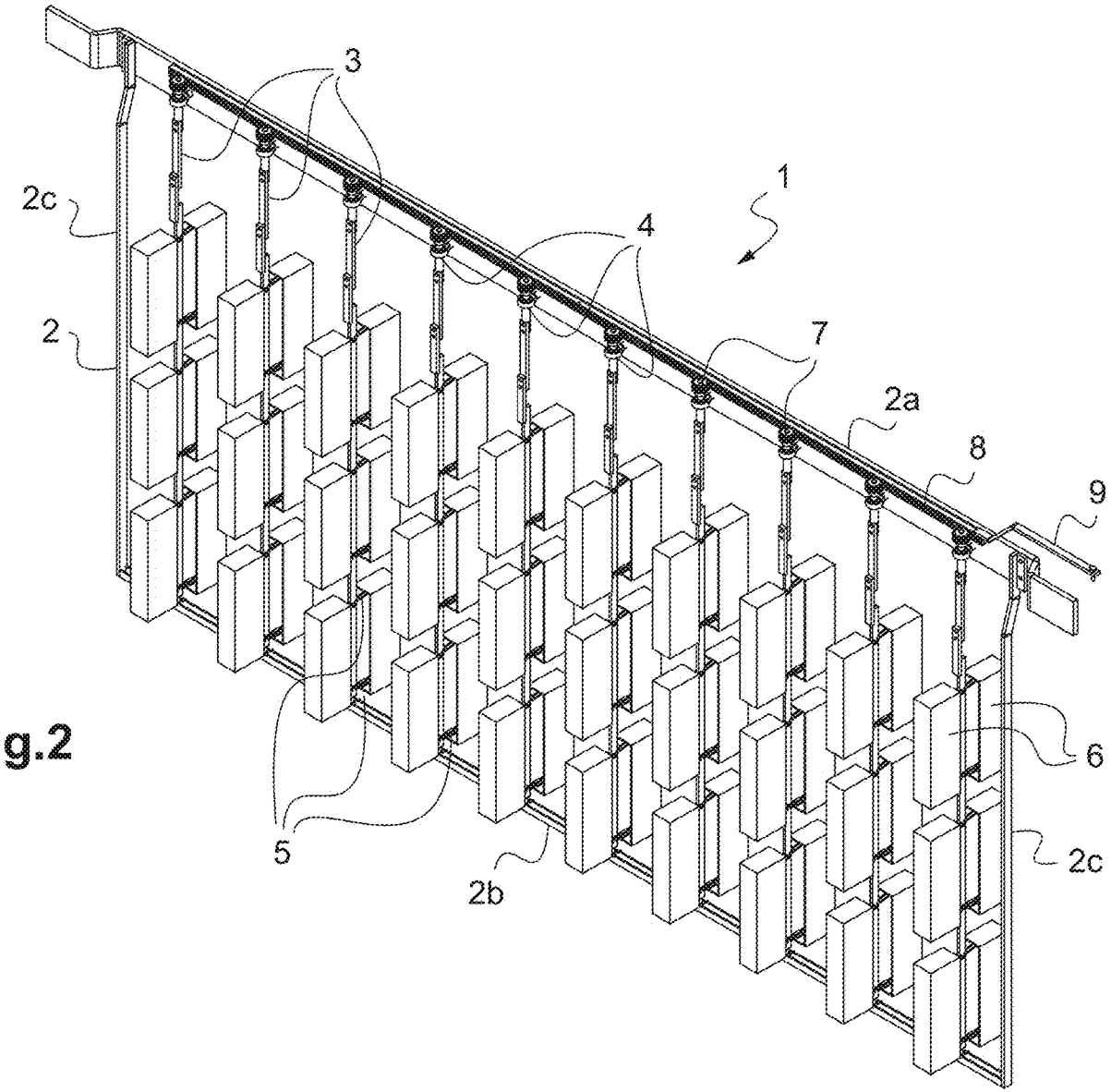
Figure 2A:
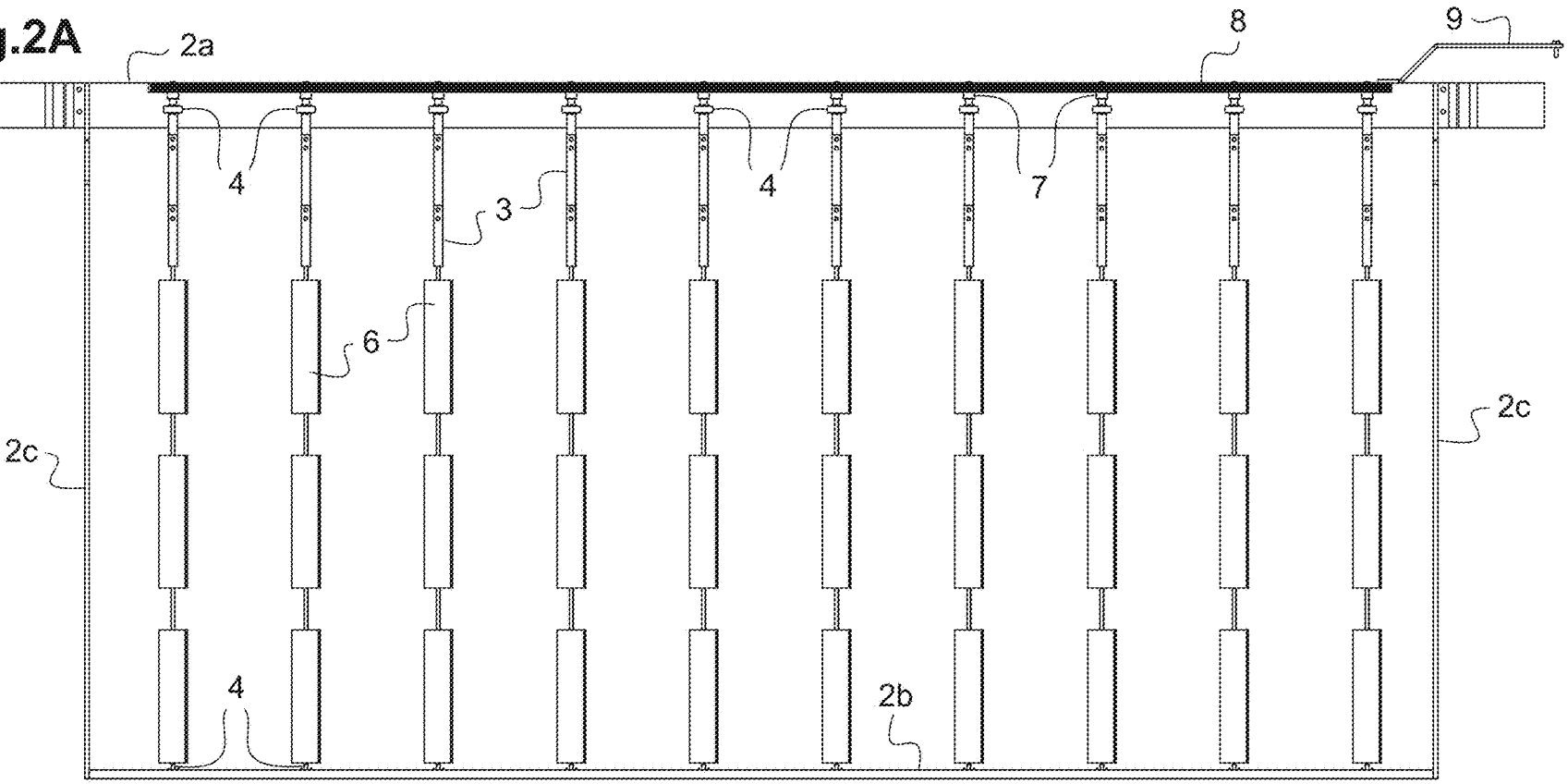
FIGS. 2A and 2B are face and top views, respectively, of the part-carrier of FIG. 1.
Figure 2B:
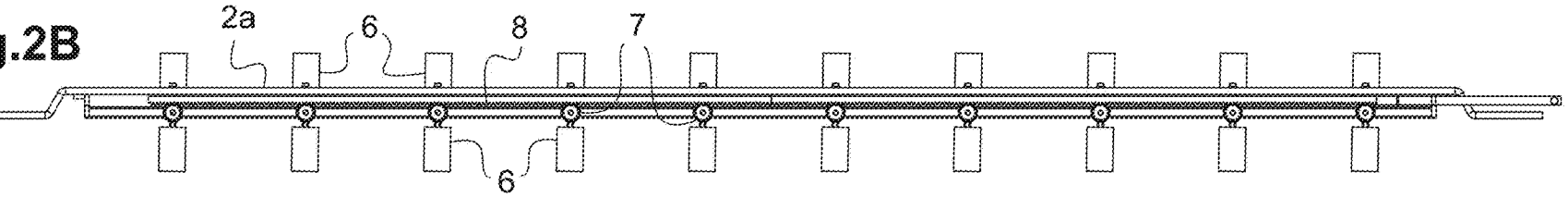

Part-carriers also called bar stands 3, also made of an electrically conductive material, arranged parallel to the lateral sides 2*c* of the reinforcement 2, are held between the upper side 2*a* and the lower side 2*b* of the reinforcement 2 so as to be able to turn about a vertical axis on either side of a neutral initial position as shown in FIG. 2. This rotatable holding may be made by means of bearings 4, for example plain bearings, integral with the upper 2*a* and lower 2*b* sides of the reinforcement 2. Means 5 for fastening the parts 6, for example clamps, clips or springs, are arranged along the supports. In the represented embodiment, the part fastening means 5 are arranged along supports 3 so as to hold the parts 6 by opposite pairs. Of course, other arrangements of fastening means 5, for example staggered arrangement, are conceivable as a function of the geometry of the parts to be treated and of the contemplated treatments.

The upper end of each of the rotary supports 3 is provided with a pinion 7 that engages with a rack 8 integral with the upper side 2*a* of the reinforcement 2. An end of the rack 8 is integral with an operating arm 9, whose free end may be removably connected to the control rod 11 of a linear actuator 10 such as a cylinder.

A horizontal translation of the rack 8, a one direction or the other, makes the supports 3, and as the result the parts 6, rotate on either side of the neutral initial position.

Of course, the control of the rotation of the supports 3 and hence of the parts 6 could be made by other means such as a cam system, or an endless screw system.

The upper side 2*a* of the reinforcement is a bar ensuring the holding of the reinforcement 2 in the treatment tank and the supply of current to the rotary supports 3.

As well known, the reinforcement 2, the supports 3 and the part fastening means 5 are made of an electrically conductive material and form together an electrode, in particular the cathode of a device for electrolytic or anodic oxidation treatment, in particular electroplating, and means are provided, generally on the upper side 2*a* by the connection to a source of current.

Figure 3:
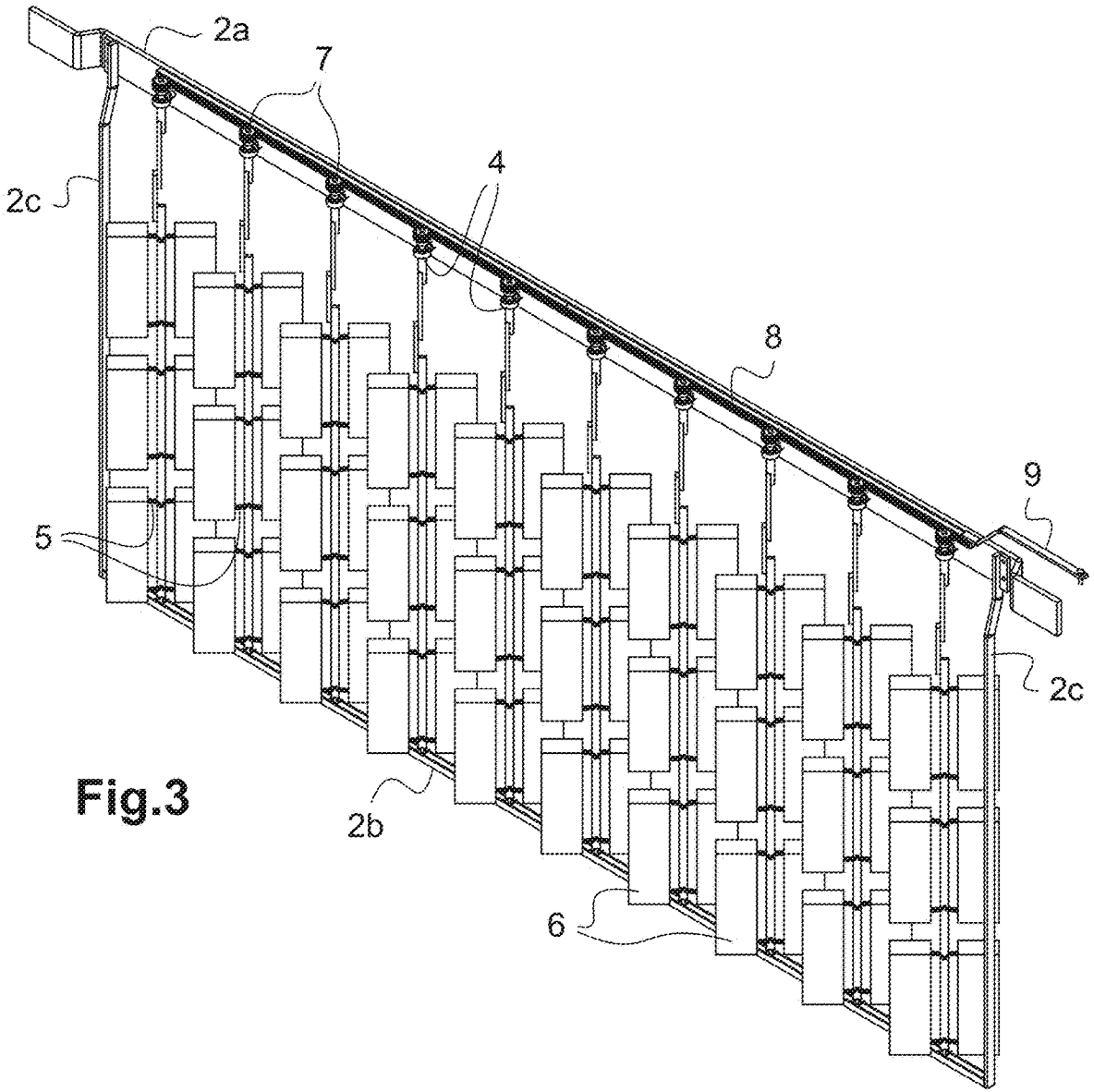
Figure 3A:
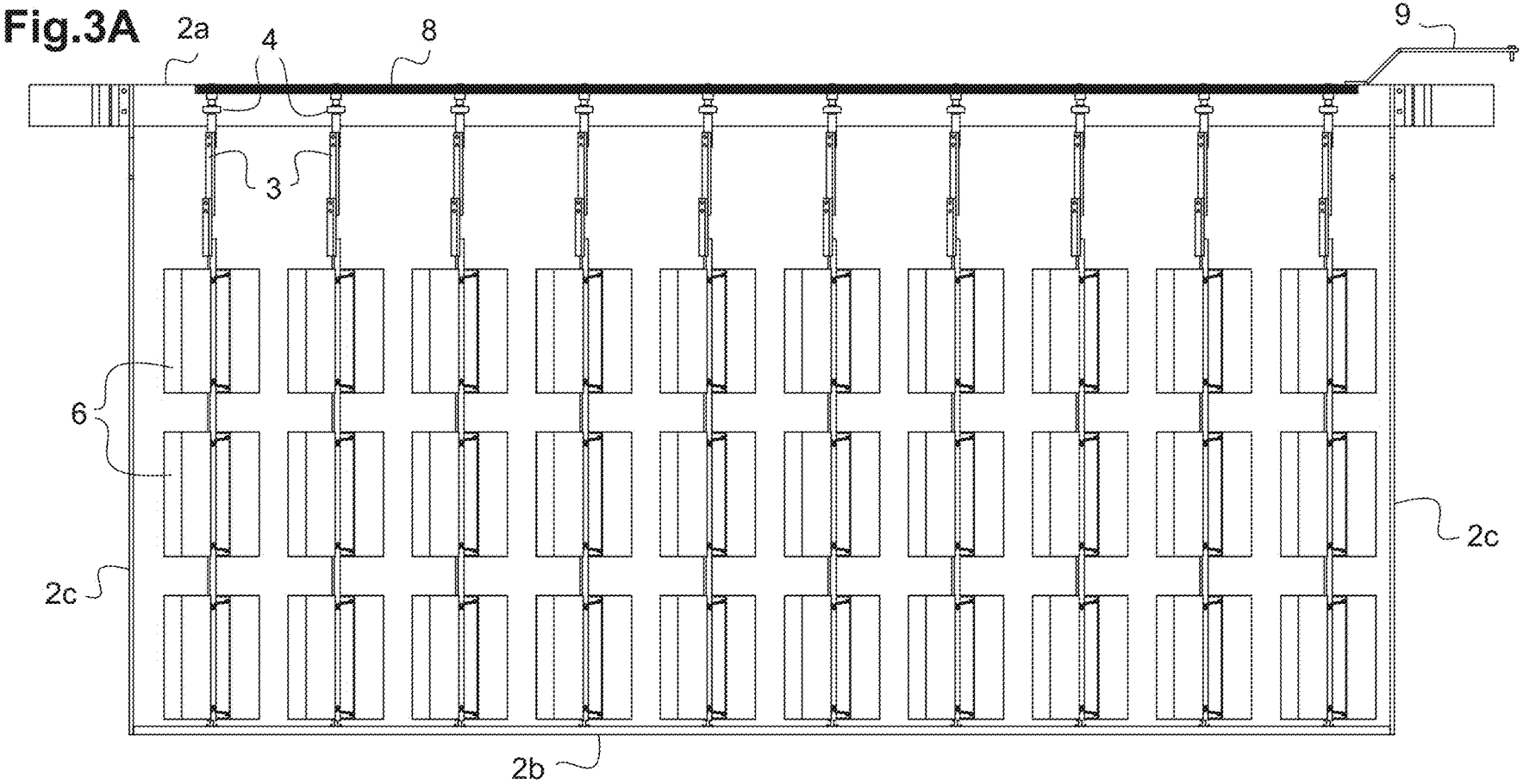
FIGS. 3A and 3B are face and top views, respectively, of the part-carrier of FIG. 3.
Figure 3B:
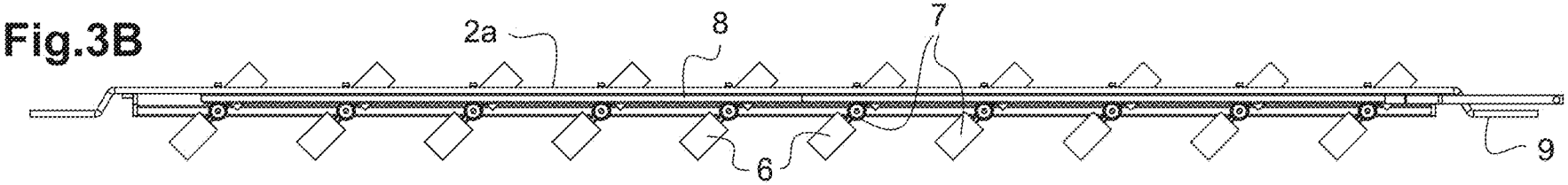
Figure 4A:
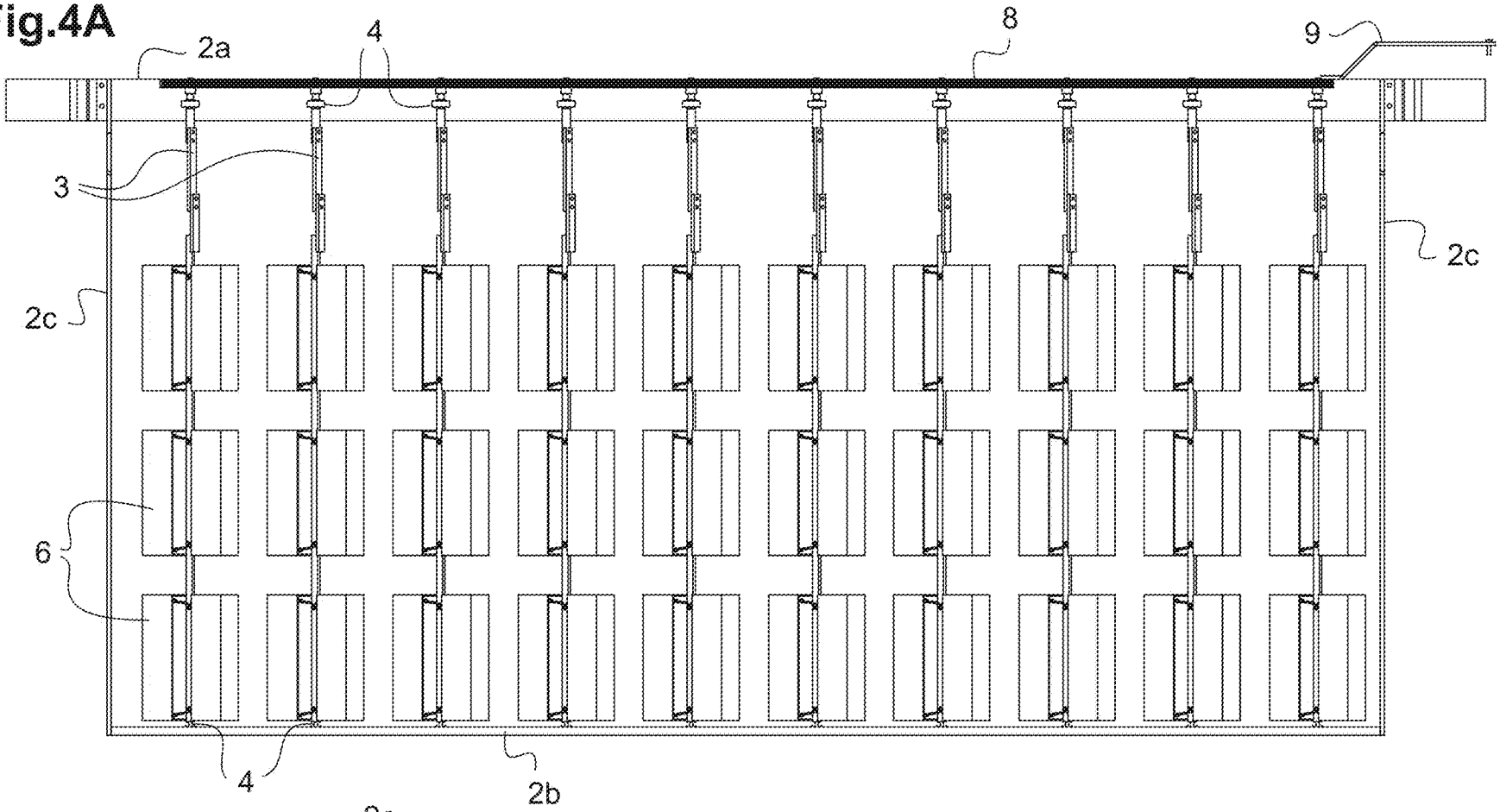
FIGS. 4A and 4B are face and top views, respectively, of the part-carrier of FIG. 1, after a rotation by 45° in the anticlockwise direction with respect to the neutral initial position.
Figure 4B:
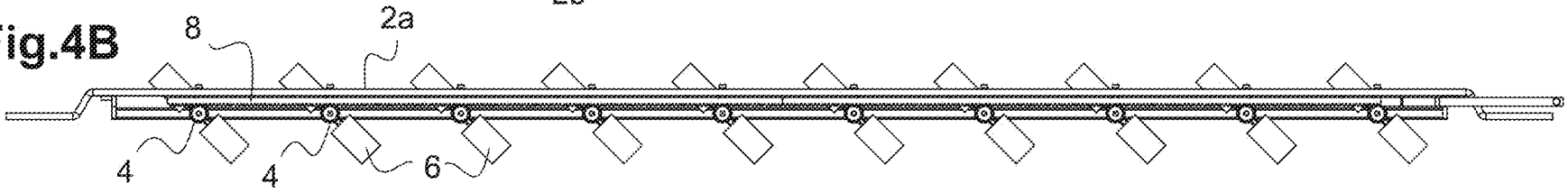

By way of illustration, FIGS. 3, 3A and 3B show in perspective, face and top view, respectively, after a rotation of the supports 3 by 45° in the clockwise direction, and FIGS. 4A and 4B show a face and top view, after a rotation by 45° in the anticlockwise direction, the positioning of the parts to be treated with respect to the neutral initial position of FIG. 2. The parts to be treated hence undergo a rotation along an arc of a circle and that is oscillatory.

The part-carrier 1 according to the invention is particularly designed to be used in a device for electrolytic and anodic oxidation treatment, in particular electroplating, and the implementation of the method of the invention.

With reference to FIGS. 5 to 10, we will now describe an embodiment of a treatment device according to the invention, as well as the implementation of the method of the invention.

Figure 5:
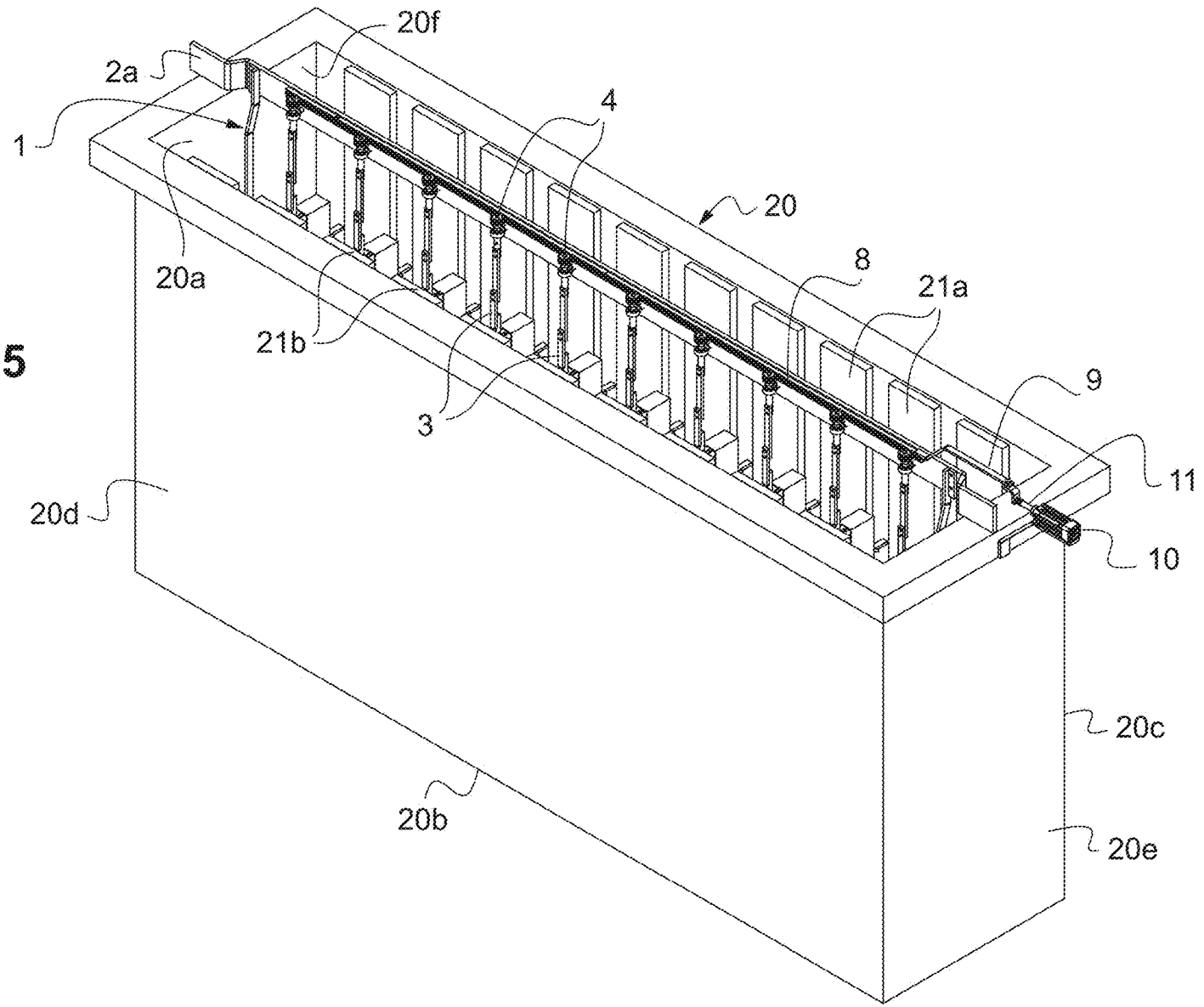

FIG. 5 shows the part-carrier 1 of the invention, placed in a treatment tank 20 of a device according to the invention. As shown in FIG. 5, the treatment tank 20 is of generally parallelepipedal shape.

The tank 20 comprises an open upper face 20*a*, a bottom 20*b* and two pairs of opposite lateral walls, a main pair 20*c*, 20*d* and a secondary pair 20*e*, 20*f*.

A set of electrodes 21*a*, 21*b*, typically anodes, is arranged vertically along each of the opposite main lateral walls 20*c*, 20*d*, and are for example in the form of vertical and parallel rectangular electrically conductive bands, The part-carrier 1 is arranged and held vertically in the tank 20 between the sets of electrodes 21*a*, 21*b*, the ends of the upper side 2*a* of the reinforcement 2 bearing on the upper edges of the secondary lateral walls 20*e*, 20*f*, the supports 3 being then arranged vertically opposite the sets of electrodes 21*a*, 21*b*, in particular on each of the bands constituting the sets of electrodes.

A linear actuator 10 is fixed on the upper edge of a secondary lateral wall 20*e* and is removably connected by its control rod 11 to the operation arm 9 of the rack 8.

Figure 9:
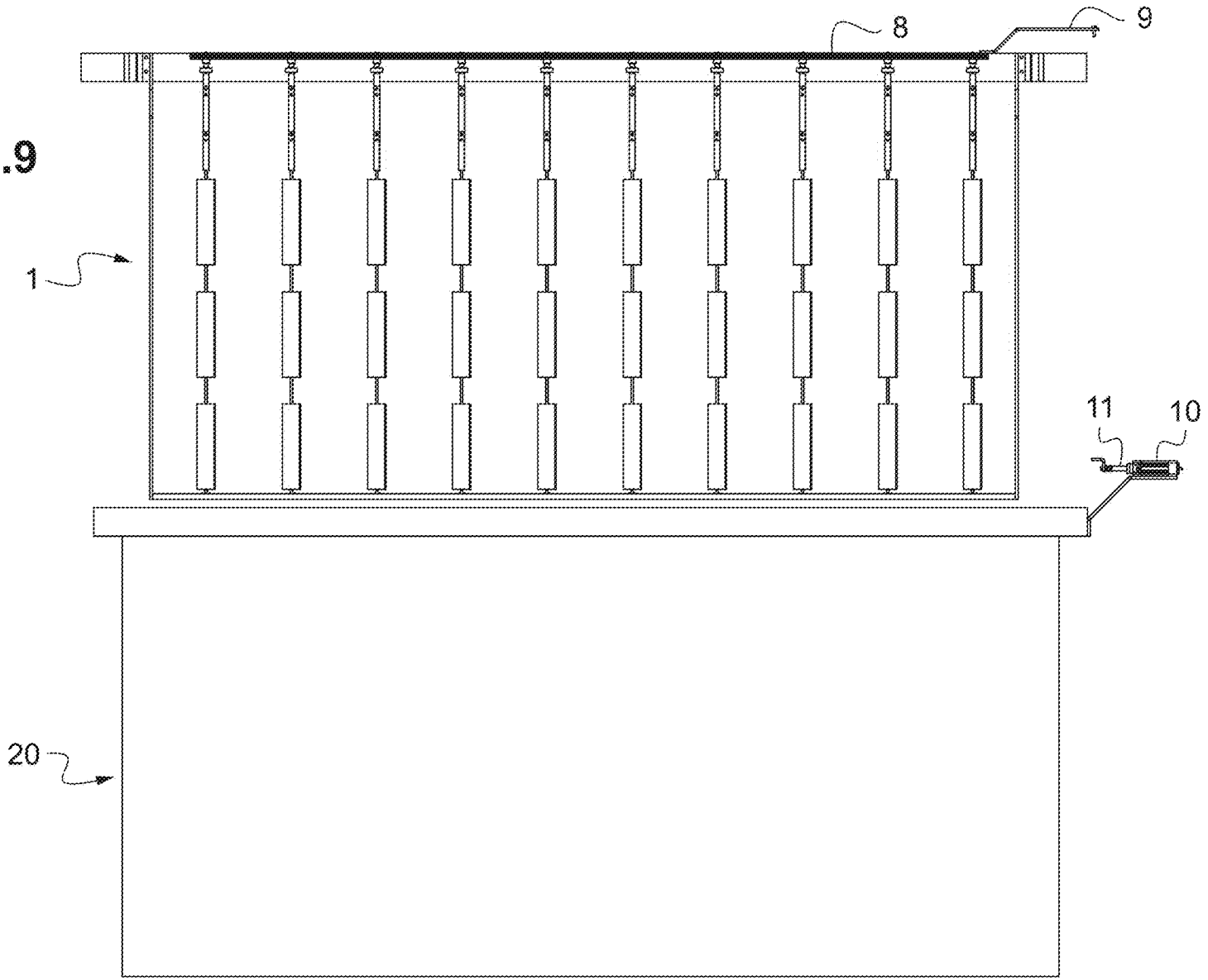
Figure 10:
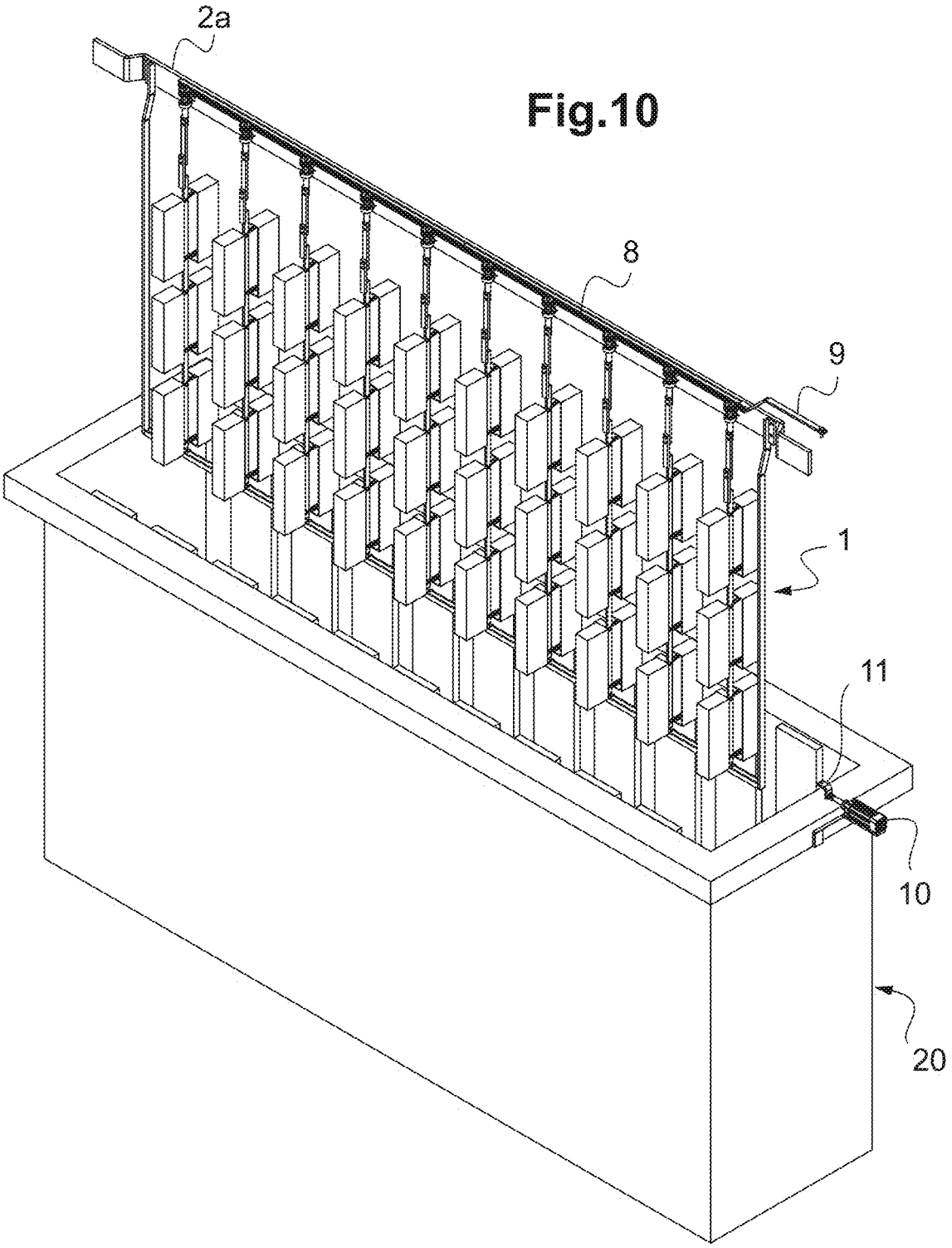

FIGS. 9 and 10 are face and perspective views of a treatment device according to the invention, with the part-carrier 1 out of the treatment tank 20, before or after a treatment. In this embodiment, the linear actuator 10 remains on the tank 20 with disengagement of the operation arm 9 of the rack 8.

Of course, the device according to the invention may include several successive tanks as described hereinabove, for different successive treatments of the parts 6 carried by a same part-carrier 1.

If, in the embodiment of the device described hereinabove, it is provided an actuator 10 fixed on each treatment tank, it is possible, as a variant, to provide a single actuator fixed to the upper rod 2*a* of the reinforcement 2 of the part-carrier 1, this actuator being then transported from tank to tank in the same time as the part-carrier.

An implementation of the method of the invention will now be described in connection with FIGS. 5 to 10 and within the framework of an electrolytic treatment.

Figure 6:
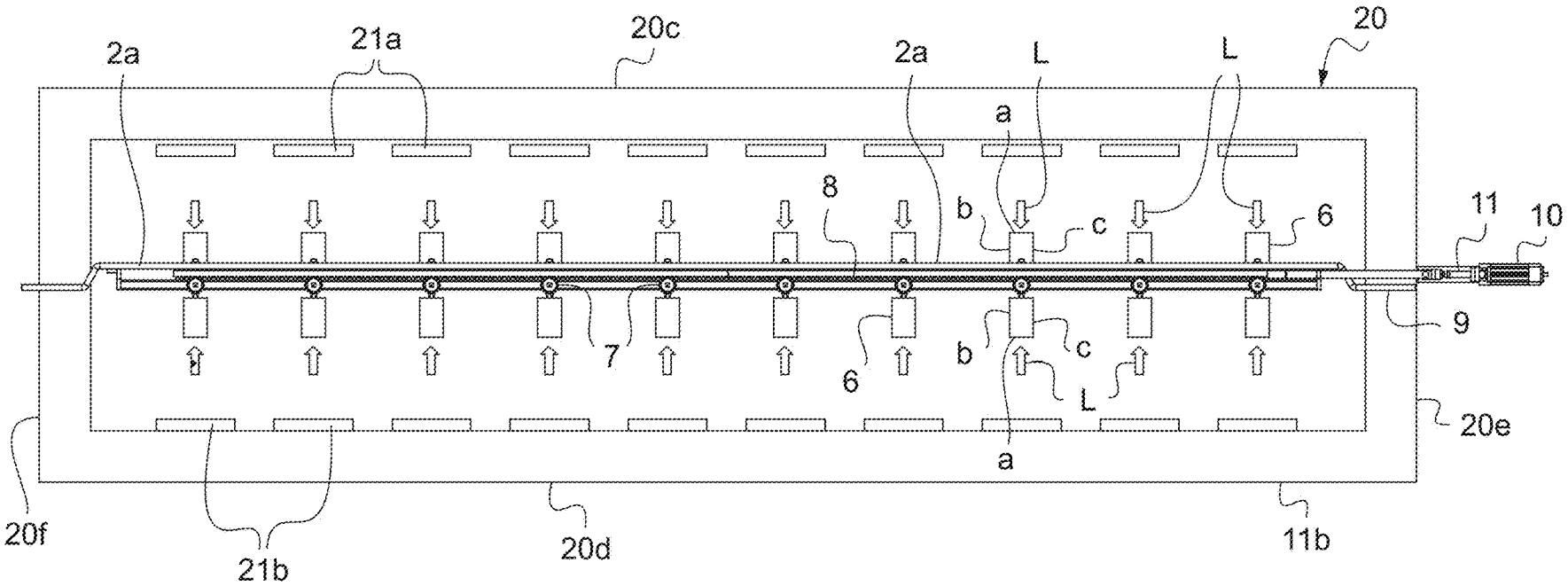

As shown in FIGS. 5 and 6, the part-carriers 1 described hereinabove, with the geometrically complex parts 6 to be treated arranged on the rotary supports 3, is placed vertically in a treatment tank 20 containing an electrolyte bath, between the sets of anodes 21*a* and 21*b*, the upper rod 20*c* of the reinforcement 2 bearing on the opposite sides of the open upper surface 20*a* constituting the upper edges of the secondary lateral surfaces 20*e*, 20*f* of the tank 20, not provided with anodes. The rod 2*a* is connected to a source of current, for example by means of a conductive braid or contact V-blocks (not shown). The rotary supports 3 are electrically connected to the rod 2*a* by means of conductive braids (not shown).

In operation, the reinforcement 2 and the parts 6 form a cathode opposite the sets of anodes 21*a* and 21*b*.

The rack 8 is connected through the operation arm 9 to the rod 11 of a linear actuator 10, for example a cylinder, fixed to the upper edge of the secondary lateral surface 20*e* of the tank 20.

At this step, the supports 3, and then the parts to be treated 6, are in a neutral initial position in which the surfaces 'a' of the parts 6 are directly opposite the anodes 21*a*, 21*b* and are directly impacted by the lines of current L established between the anodes and the cathode during the treatment. On the other hand, the surfaces 'b' and 'c' of the parts 6 that are not opposite the anodes 21*a*, 21*b*, are a little or not impacted by the lines of current L.

During the treatment, the linear actuator 10 is sequentially activated.

In the implementation shown, the linear actuator 10 is activated a first time to make the rod 11 move rearward and hence perform a translation to the right of the rack 8. This translation to the right of the rack 8 has for effect to make the supports 3 pivot in the clockwise direction, herein by an angle of 45° with respect to the neutral initial position.

Figure 7:
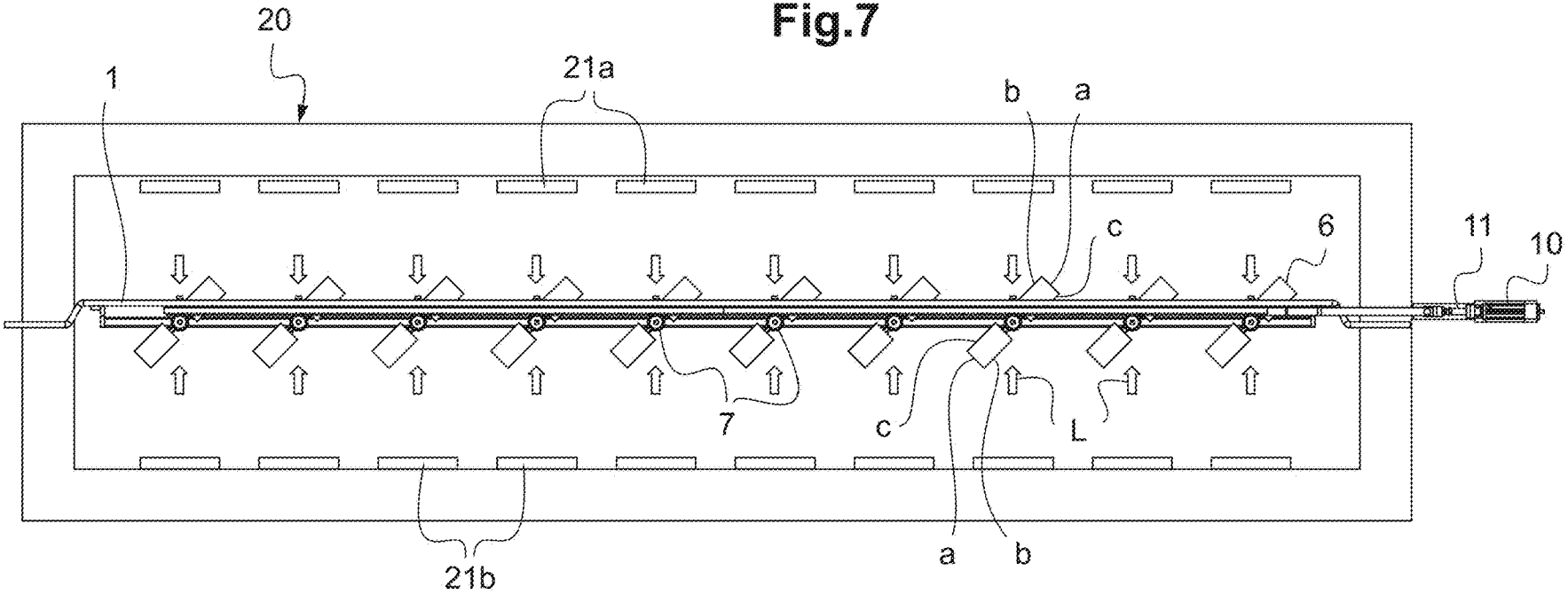
Figure 8:
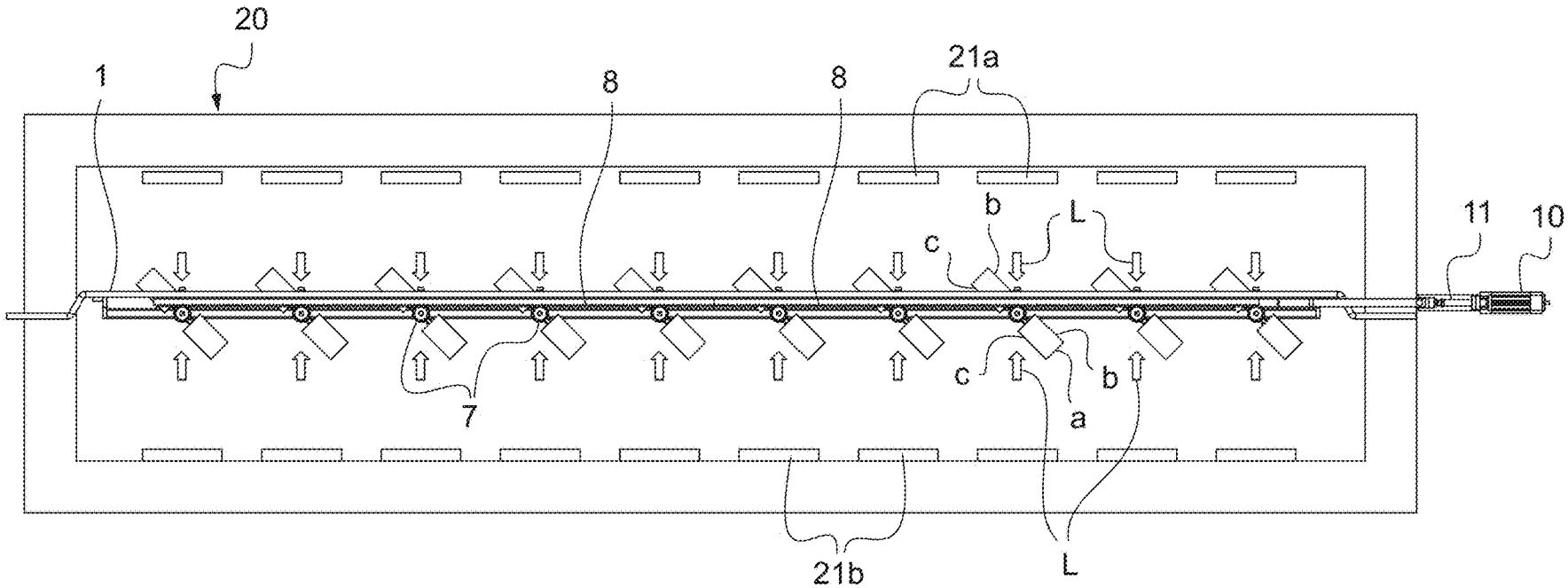

After this rotation of the supports 3, the exposure of the surfaces 'b' of the parts 6 to the anodes is increased and the impact of the lines of current on theses surfaces is increased (FIG. 7).

The linear actuator 10 is then activated a second times to make the rod 11 move forward and hence perform a translation to the left of the rack 8. This translation to the left of the rack 8 has for effect to make the supports 3 pivot in the anticlockwise direction, herein by an angle of 45° with respect to the neutral initial position.

After this rotation of the supports 3, the exposure of the surfaces 'c' of the parts 6 to the anodes is increased and the impact of the lines of current L on theses surfaces c is increased.

Of course, according to the treatment and the complexity of the part geometry (FIG. 8), it may be used during the treatment several rotations by an angle comprised between 0 degree (neutral initial position) and 90° on either side of the neutral initial position.

Likewise, the time of holding at each of the chosen positions will depend on the treatment and of the geometrical complexity of the parts.

In the case of an electroplated coating, the rotation angles and the time of holding at the different angular positions will be chosen so as to obtain the most homogeneous possible coating, and in particular of thickness the most equal possible.

The sequence of rotations during a treatment may be controlled automatically by a computer program.

At the end of the treatment, the operating arm 9 is locked at the neutral position and is disconnected from the rod 11 of the actuator and the upper rod 2*a* is disconnected. The part-carrier 1, with the parts 6 to be treated, is then removed from the tank 20, the actuator 10 remaining fixed to the tank 20.

The part-carrier 1, with the parts 6, may then be placed in another treatment enclosure for another electrolytic treatment or another treatment, for example drying, curing, etc., or the parts 6 may be dismounted from the part-carrier 1 and stored before shipping.

The invention claimed is:

1. A method for electrolytic or anodic oxidation surface treatment comprising the positioning in a neutral initial position, by means of a removable part-carrier, geometrically complex parts constituting a first electrode, in a treatment bath contained in a tank including one second electrode of polarity opposite to that of the first electrode, the geometrically complex parts made of metal or metallizable plastic material, wherein:

a) the geometrically complex parts are such that, in a neutral initial position at 0 degree; and b) during the treatment of the geometrically complex parts, the geometrically complex parts are subjected to sequential rotations on either side of their neutral initial position by an angle up to 90 degrees, so as to increase the exposure to lines of current established between the first and the second electrode during the implementation of the treatment method;

wherein the geometrically complex parts to be treated are held in different angular positions resulting from the sequential rotations during a determined time as a function of the treatment and of the geometric complexity of the parts.

2. The method of claim 1, wherein the angle of rotation of the geometrically complex parts is of 45 degrees on either side of the neutral initial position.

* * * * *